US006782579B1

(12) United States Patent
Grimm

(10) Patent No.: US 6,782,579 B1
(45) Date of Patent: Aug. 31, 2004

(54) ATTACHABLE DUSTER FOR CEILING FANS

(76) Inventor: Charles L. Grimm, 2617 Frank's Creek Rd., Flat Gap, KY (US) 41219

( * ) Notice: Subject to any disclaimer, the term of this patent is extended or adjusted under 35 U.S.C. 154(b) by 84 days.

(21) Appl. No.: 10/267,561

(22) Filed: Oct. 9, 2002

(51) Int. Cl.[7] ..... F04D 29/70
(52) U.S. Cl. ..... 15/246; 416/62; 416/146 R
(58) Field of Search ..... 15/106, 118, 160, 15/166, 210.1, 220.4, 246; 416/146 R, 62

(56) References Cited

U.S. PATENT DOCUMENTS

| | | | | |
|---|---|---|---|---|
| 2,575,361 A | * | 11/1951 | Reip | 15/220.4 |
| 4,823,431 A | | 4/1989 | Carpenter | |
| 4,827,556 A | * | 5/1989 | Corsetti | 15/244.1 |
| 5,018,944 A | * | 5/1991 | Bielecki et al. | 416/146 R |
| 5,232,347 A | * | 8/1993 | VonBergen | 416/244 R |
| 5,313,687 A | | 5/1994 | Schneider | |
| 5,319,821 A | | 6/1994 | Nicholson et al. | |
| 5,410,776 A | | 5/1995 | Schneider | |
| 5,488,754 A | | 2/1996 | Shadley | |
| 5,598,602 A | * | 2/1997 | Gibson | 15/220.4 |
| 5,765,259 A | | 6/1998 | Cika | |
| 6,022,192 A | * | 2/2000 | DeLaHoz et al. | 416/146 R |
| 6,345,409 B1 | | 2/2002 | LaCroix | |

* cited by examiner

*Primary Examiner*—Randall Chin
(74) *Attorney, Agent, or Firm*—John D. Gugliotta; Olen L. York, III

(57) ABSTRACT

The adjustable ceiling fan blade cleaner consists of a clamp that connects around the body of a ceiling fan motor via a two-member telescoping ring. Two arms project out the end of the cleaner. Each arm then has a section of cloth that hangs down and slightly drapes over the fan blade in much the same manner as a flag. Thus as the blades of the fan turn, the cloth swipes off any dust. When dirty, the cloths are simply slid off of the end, washed, and then replaced. Disposable, one-time cleaning cloths may also be used as well. The use of the attachable duster for ceiling fan allows for virtually effortless cleaning of ceiling fan blades in a manner, which is quick, easy and effective.

20 Claims, 5 Drawing Sheets

ATTACHABLE DUSTER FOR CEILING FANS

RELATED APPLICATIONS

The present invention was first described in Disclosure Document Registration 507,255 filed on Mar. 6, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to cleaning of ceiling fan blades, and more specifically to an attachment that allows the ceiling fan to operate in a self-cleaning fashion.

2. Description of the Related Art

With today's fast-paced lifestyles, people are becoming increasingly pressed to accomplish the variety of household chores under their responsibility. One of these chores is that of dusting. While most dusting is accomplished with a simple rag, there are some locations that are harder to get at, yet, must be done since they are visible to the casual observer. One such location is that of ceiling fan blades. Not only do ceiling fan blades collect the normal amount of dust as other locations, they also attract dust while in operation. While some cleaning devices with long handles are available, they still require time to use, and usually do a less than satisfactory job. A step-stool is usually required to clean the fan blades thoroughly, but once again, this requires even more time, and exposes the person to a dangerous fall. There are also a number of vacuum attachments available for cleaning ceiling fan blades. Accordingly, there is a need for a means by which ceiling fan blades can be kept clean at all times in a continuous manner.

A search of the prior art did not disclose any patents that read directly on the claims of the instant invention; however, the following references were considered related:

U.S. Pat. No. 6,345,409, issued in the name of LaCroix, describes a vacuum nozzle for cleaning ceiling fan blades;

U.S. Pat. No. 5,765,259, issued in the name of Cika, describes a vacuum nozzle for cleaning ceiling fan blades;

U.S. Pat. No. 5,488,754, issued in the name of Shadley, describes a vacuum nozzle for cleaning ceiling fan blades;

U.S. Pat. No. 5,410,776, issued in the name of Schneider, describes a vacuum nozzle for cleaning ceiling fan blades;

U.S. Pat. No. 5,319,821, issued in the name of Nicholson, describes a vacuum nozzle for cleaning ceiling fan blades;

U.S. Pat. No. 5,313,687, issued in the name of Schneider, describes a vacuum nozzle for cleaning ceiling fan blades; and U.S. Pat. No. 4,823,431, issued in the name of Carpenter, describes a vacuum nozzle for cleaning ceiling fan blades.

Consequently, there exists a need for new product ideas and enhancements for existing products in the ceiling fan industry directed at self-cleaning of the fan blades.

SUMMARY OF THE INVENTION

It is therefore an object of the present invention to provide an adjustable duster attachable to a ceiling fan for cleaning fan blades during operation.

It is a feature of the present invention to provide an adjustable duster having adjustable arms for proper positioning of the arms.

It is a further feature of the present invention to provide an adjustable duster having disposable dusting apparatuses capable of easy removal and replacement.

It is a further feature of the present invention to provide an adjustable duster having dusting cloths chemically treated with static enhancing material to provide enhanced attraction of dust and debris.

It is a further feature of the present invention to provide an adjustable duster having dusting cloths chemically treated with fragrances for permeating a room in which the ceiling fan is used, providing a fresh and pleasant smell to that room.

Briefly described according to one embodiment of the present invention, the attachable duster for a ceiling fan is an apparatus that provides self cleaning capability to ceiling fans. The invention consists of a clamp that connects around the body of the ceiling fan motor via a strap or similar method. From this clamp, two or more extendable rods protrude out the end of the fan blades. Each rod then has a section of cloth that hangs down and slightly drapes over the fan blade in much the same manner as a flag. Thus as the blades of the fan turn, the cloth swipes off any dust. When dirty, the cloths are simply slid off of the end, washed, and then replaced. Disposable, one-time cleaning cloths may also be used as well. The use of the attachable duster for ceiling fan allows for virtually effortless cleaning of ceiling fan blades in a manner, which is quick, easy and effective.

The use of the present invention provides users with all of the materials and tools necessary to ensure that a user may easily use and maintain an adjustable duster attachable to a ceiling fan.

An advantage of the present invention is that it is specifically adapted for home or office use.

A further advantage of the present invention is that it provides a unique alternative to the vacuum attachments necessary to clean the top portion of ceiling fan blades.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
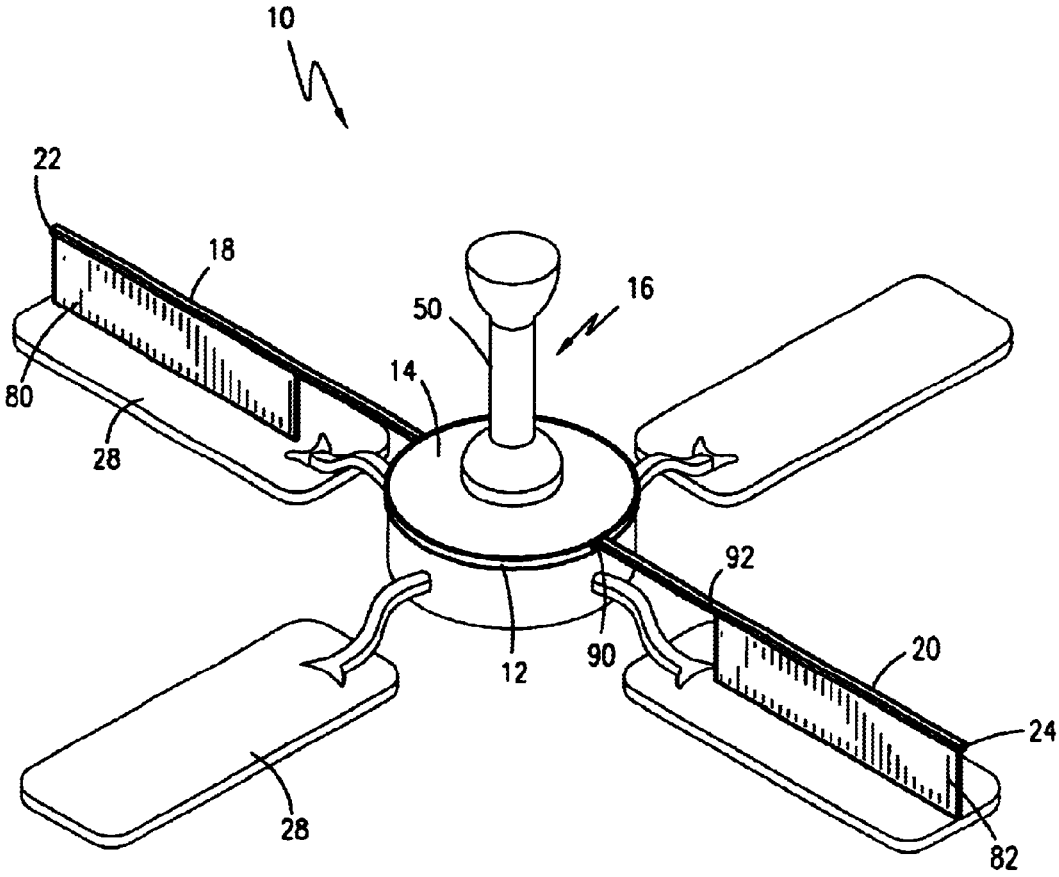
FIG. 1 is a perspective view of an adjustable duster affixed to a ceiling fan.

Referring now to FIG. 1, an attachable duster for a ceiling fan blade 10 is shown in accordance with the preferred embodiment of the present invention. The attachable duster 10 includes an adjustable telescoping ring 12 for mounting the attachable duster 10 to the motor housing 14 of a ceiling fan 16. A pair of arms 18 and 20 are projecting away from the ring 12 and are positioned 180° apart along the outer circumference of the ring 12. A corresponding pair of dusting cloth apparatuses 22 and 24 project downward from the arms 18 and 20. As the fan blades 26 rotate, in either a clockwise or counterclockwise fashion, the dusting cloth apparatuses 22 and 24 brush against and clean the top surface of the fan blades 28.

Figure 2A:
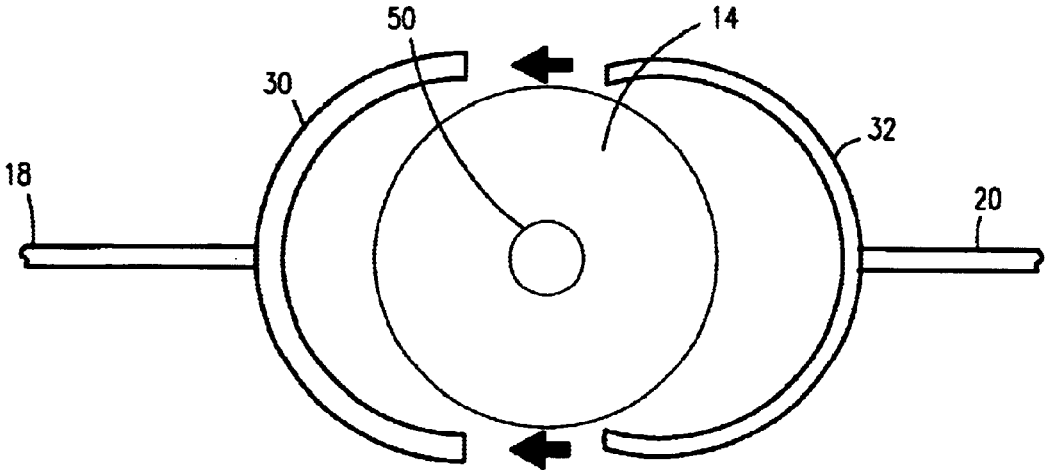
FIG. 2*a* is a top view of the apparatus of FIG. 1, illustrating the detached arrangement of a ring and ring members.
Figure 2B:
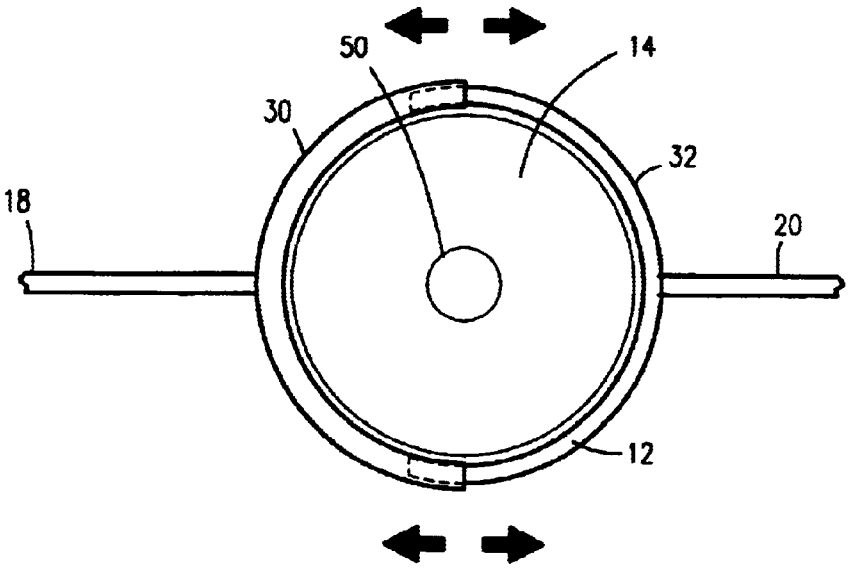
FIG. 2*b* is a top view of the apparatus of FIG. 2*a*, illustrating the attached arrangement of a ring and ring members, wherein the ring is attached to the motor housing of a ceiling fan.
Figure 3:
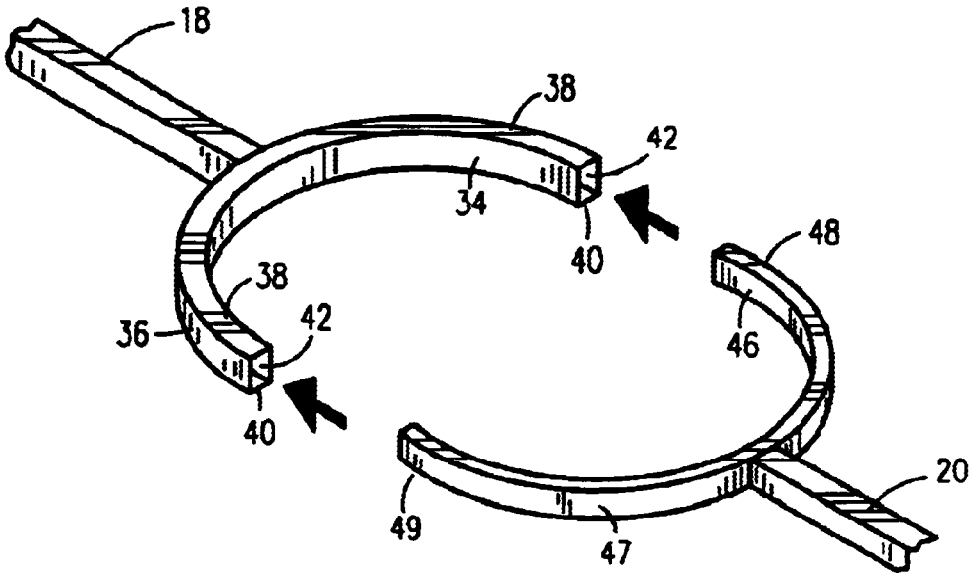
FIG. 3 is a perspective view of the apparatus of FIG. 2*a* and FIG. 2*b*, illustrating the channel formed by within the first ring member and the slidable insertion of the second ring member with the channel.
Figure 4:
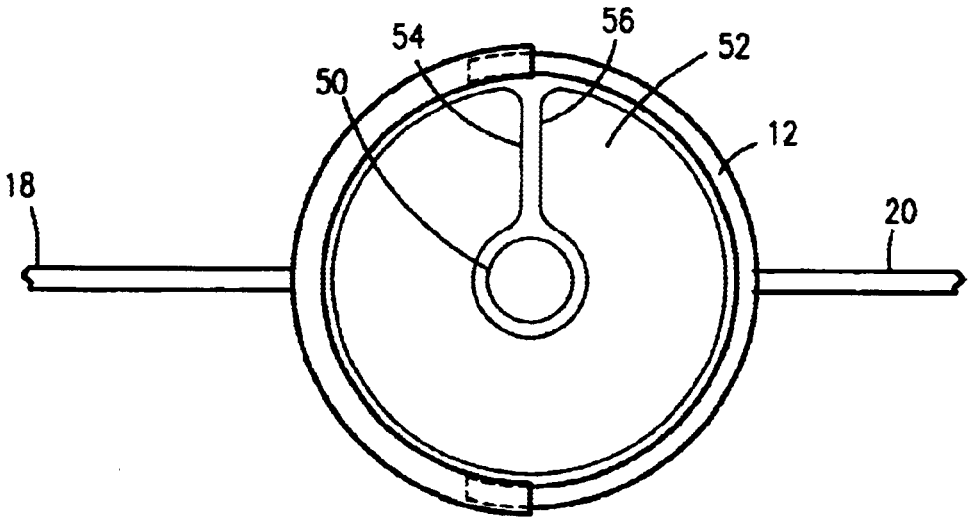
FIG. 4 is a top view of the apparatus of FIG. 2*a* and FIG. 2*b*, and illustrating the collar incorporated into the attachment of the adjustable duster to the spindle of the ceiling fan (as opposed to the motor housing depicted in FIG. 1, FIG. 2*a* and FIG. 2*b;*

Referring now to FIG. 2, FIG. 3 and FIG. 4, the adjustable telescoping ring 12 includes a first ring member 30 and a second ring member 32. The first ring member 30 includes a curvilinear first sidewall 34 opposite to a curvilinear second sidewall 36. The top portions of the curvilinear first and second sidewalls 34 and 36 depend from a curvilinear top wall 38. The bottom portions of the curvilinear first and second sidewalls 34 and 36 depend from a curvilinear bottom wall 40. The first and second sidewalls 34 and 36 and the top and bottom walls 38 and 40 form a first ring member cavity 42 that transverses the first ring member 30 so as to accommodate the second ring member 32.

The second ring member 32 includes a curvilinear anterior portion 46 and an opposing curvilinear posterior portion 47. The second ring member 32 further includes a curvilinear top portion 48 and an opposing curvilinear bottom portion 49. Unlike the first ring member 30, however, the second ring member 32 does not include a cavity, but is instead a generally solid component that telescopes into and out of the first ring member cavity 42 described above. The telescoping action of the ring 12, and its first and second ring members 30 and 32, allow the ring 12 inward or outward movement and thereby providing the adjustability necessary so that the ring 12 may accommodate the various sized ceiling fan motor housings 14 or the spindle 50 found in the industry. It is also envisioned, in an alternative embodiment of the present invention, that the ring 12 may have a hinge and a latch, whereby a user could attach the ring 12 to a ceiling fan by releasing the latch, pivoting the hinge to an open position, sliding the ring 12 around the ceiling fan, and then securing the latch to provide a secure fit. In addition, other similar attachment devices are envisioned as being incorporated into the adjustable duster 10.

The ring 12 may also include an adapter collar 52 (as illustrated in FIG. 4) that has an annular shape with a first end portion 54 that abuts to a second end portion 56. The collar 52 is necessary if placement of the ring 12 onto the motor housing 14 is not practicable. For instance, some ceiling fans have a motor housing that also rotates as the blades are rotated. Attachment of the ring 12 to the rotating motor housing would render the adjustable duster 10 ineffective, since the duster 10 would rotate at the same speed and along the same path as the fan blades, and thus would not clean the blades as envisioned. For such a circumstance, the collar 52 is provide to snugly fit around the ceiling fan spindle 50, wherein the first end portion 54 is separated from the second end portion 56 until the collar 52 is placed around the spindle 50. Then, the ring 12 may be adjusted about the collar 52 until the ring 12 abuts against the collar 52, which then abuts to the spindle 50, thereby providing a suspended, yet secure, connection of the adjustable duster 10 to the ceiling fan 16.

Figure 5:
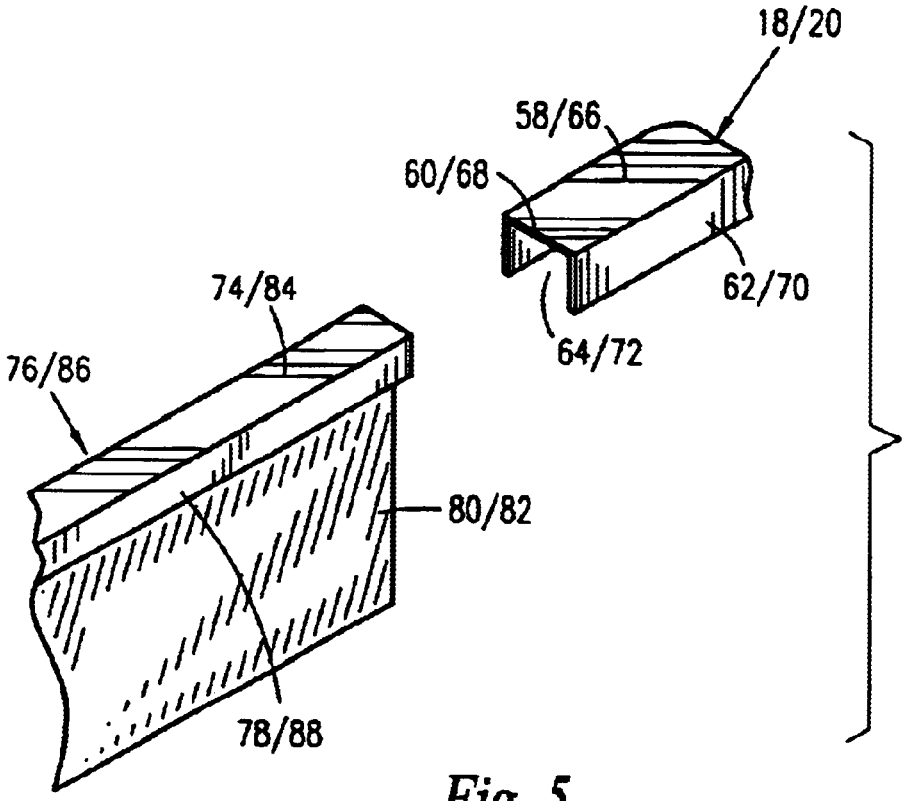
FIG. 5 is an exploded perspective of a dusting apparatus detached from an arm.
Figure 6:
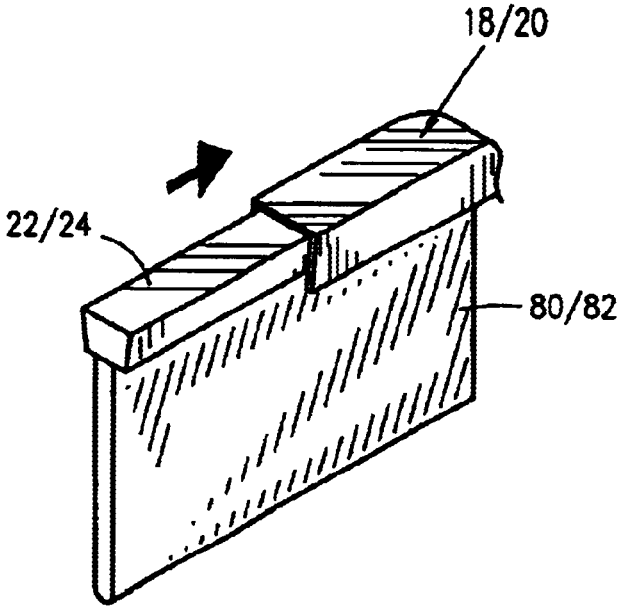
FIG. 6 is a perspective of the apparatus shown in FIG. 5, illustrating the slidable insertion of the dusting apparatus into the arm.
Figure 7:
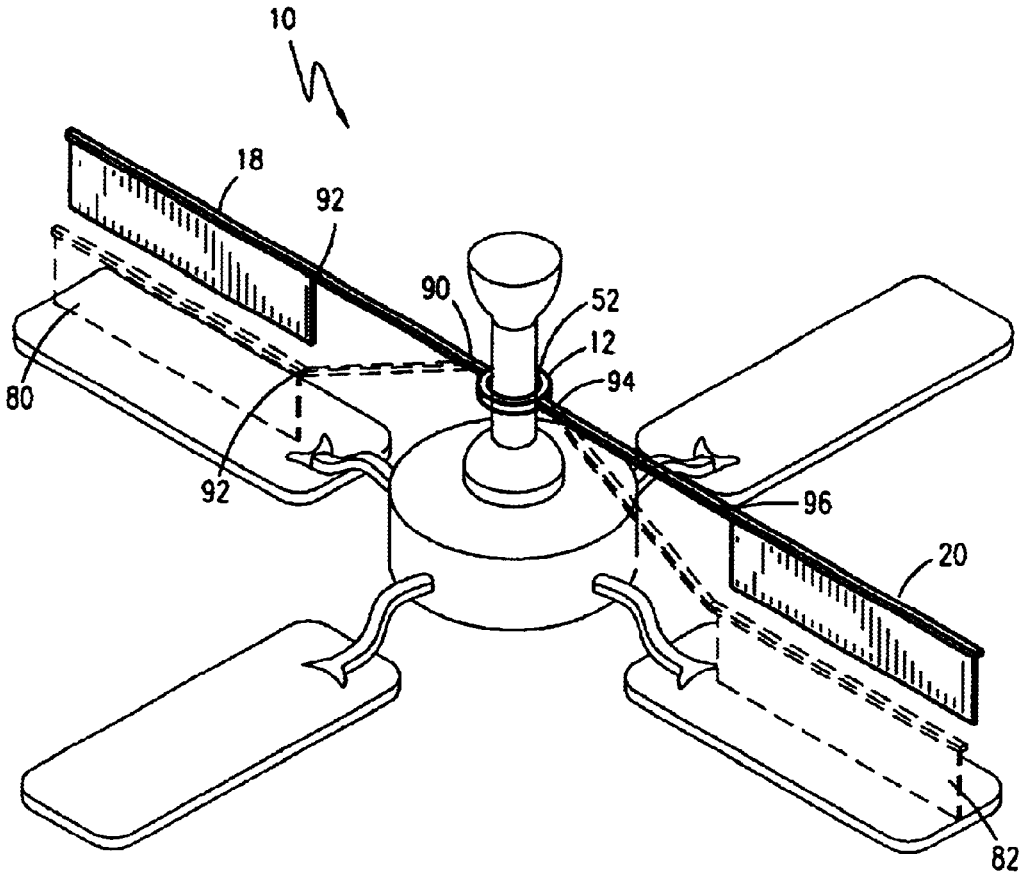
FIG. 7 is a perspective of the apparatus of FIG. 1 illustrating the pivots provided for adjusting the angle and arrangement of the arms and the dusting cloths in relation to the fan blades.

Referring now to FIG. 5 and FIG. 6, the pair of arms 18 and 20 includes a first arm 18 and a second arm 20. The first and second arms 18 and 20 are mirror images of one another, therefore the following detailed description of the first arm 18 will serve as a representative description of the second arm 20, wherein the reference numerals for the corresponding components of the second arm 20 are in parentheses. The first arm 18 is a linearly elongated member depending from the first ring member 30 and having a first top surface 58 (or second top surface 66) and a pair of downwardly projecting beams 60 (68) and 62 (70) and forming a first channel 64 (or second channel 72) for receiving the dusting cloths apparatuses 22 or 24. The first beam 60 (or third beam 68) and the second beam 62 (or fourth beam 70) are inwardly biased toward the centerline of the top surface 58 (66) so as to form the first channel 64 (or second channel 72) for mechanically impinging the dusting cloth apparatuses 22 or 24. The first or second arm 18 or 20 also includes a pair of lockable and adjustable pivots 90 (94) and 92 (96), as illustrated in FIG. 7. The first and second pivots 90 (or third pivot 94) and 92 (or fourth pivot 96) provide a means for the first and second arms 18 and 20 to be adjusted at an appropriate angle for thoroughly and efficiently cleaning the fan blades during operation. The pivots 90 (94) and 92 (96) are especially advantageous for use with the embodiment incorporating the collar 52 for connecting the ring 12 to the ceiling fan spindle 50. The pivots 90 (94) and 92 (96) allow the arms to pivot downwardly (as shown by the phantom lines in FIG. 7) to provide better contact between the dusting cloths 80 and 82 and the fan blades 28.

The dusting cloths apparatuses 22 and 24 include a first dusting cloth apparatus 22, corresponding to the first arm 18, and a second dusting cloth apparatus 24, corresponding to the second arm 20. The first and second dusting cloth apparatuses 22 and 24 are mirror images of one another, therefore the following detailed description of the first dusting cloth apparatus 22 will serve as a representative description of the second dusting cloth apparatus 24, wherein the reference numerals for the corresponding components of the second dusting cloth apparatus 24 are in parentheses. The first dusting cloth apparatus 22 is a linearly elongated member having a first top segment 74 (or second top segment 84) and two downwardly projecting first side segment 76 (or third side segment 86) and second side segment 78 (or fourth side segment 88). The side segments 76 (86) and 78 (88) are inwardly biased toward the centerline of the top segment 74 (84) so as to mechanically impinge a first or second dusting cloth 80 or 82. The first or second dusting cloth apparatus 22 or 24 is slidably inserted into the first or second channel 64 or 72 so that the first and second dusting cloths 80 or 82 are suspended from the first or second arm 18 or 20.

It is envisioned that the dusting apparatuses 22 and 24 are disposable, wherein the used and saturated dusting apparatus 22 or 24 is slidably removed from an arm 18 or 20 and a new dusting apparatus 22 or 24 is slidably inserted in an arm 18 or 20 for new and continued use. The replacement dusting apparatuses 22 or 24 may be included in the commercial embodiment or may follow as a separate commercial purchase.

An alternative embodiment of the present invention includes the chemical treatment of the first and second dusting cloths 80 and 82 so as to provide a variety of scents or cleansing effects. For example, and in no way providing a limitation to the scope of the present invention, the additives described in U.S. Pat. No. 4,636,429, issued in the name of Morrell et al., provide a process and a means for treating non-woven polypropylene webs so as to provide an increased dust-attracting capability of the fabric used in dusting furniture. In Morrell et al., the polypropylene webs are treated with polypropylene glycol by weight of 0.1% to 5.0%. The chemical treatment as described in Morrell et al. is anticipated as a general type of treatment so as to provide the dusting cloths 80 and 82 with enhanced dust-attraction capabilities and is hereby incorporated by reference herein as though written in its entirety. Further chemical enhancements may include the addition of fragrance additives, so as to provide a variety of refreshing smells to a room and exaggerated by the turning of the ceiling fan blades.

It is envisioned that other styles and configurations of the present invention can be easily incorporated into the teachings of the present invention, and only one particular configuration shall be shown and described for purposes of clarity and disclosure and not by way of limitation of the scope.

2. Operation of the Preferred Embodiment

A user will slidably insert the second member ring 32 into the first member ring 30 (as illustrated by FIG. 2*a* and FIG. 2*b*) until the ring 12 securely abuts against the motor housing 14. The user will adjust the first and second arms 18 and 20 so that the first and second dust cloths 80 and 82 are suspended at an appropriate length to thoroughly and efficiently clean dust and debris from the top portion of the fan blades 28.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A ceiling fan blade cleaner comprising:

an adjustable ring for attaching said cleaner to a ceiling fan;

a pair of arms projecting away from said adjustable ring; and a pair of dusting cloth apparatuses downwardly projecting away from said pair of arms.

2. The ceiling fan blade cleaner of claim 1, wherein said adjustable ring comprises a first ring member and a second ring member, said first ring member receiving said second ring member.

3. The ceiling fan blade cleaner of claim 2, wherein said first ring member comprises:

a curvilinear first sidewall;

a curvilinear second sidewall, said second sidewall opposite to said first sidewall;

a curvilinear top wall, said top wall depending from said first sidewall and said second sidewall;

a curvilinear bottom wall, said bottom wall opposite to said top wall, said bottom wall depending from said first sidewall and said second sidewall; said first sidewall, said second sidewall, said top wall and said bottom wall forming a cavity for receiving said second ring member.

4. The ceiling fan blade cleaner of claim 3, wherein said cavity transverses an entire length of said first ring member.

5. The ceiling fan blade cleaner of claim 2, wherein said second ring member comprises:

a curvilinear anterior portion;

a curvilinear posterior portion, said posterior portion opposite to said anterior portion;

a curvilinear top portion, said top portion depending from said anterior portion and said posterior portion;

a curvilinear bottom portion, said bottom portion opposite to said top portion, said bottom portion depending from said anterior portion and said posterior portion; said anterior portion, said posterior portion, said top portion and said bottom portion forming a solid second ring member for insertion into a cavity of said first ring member.

6. The ceiling fan blade cleaner of claim 1, wherein said pair of arms comprises a first arm and a second arm, said second arm positioned 180° apart from said first arm.

7. The ceiling fan blade cleaner of claim 6, wherein said first arm is linearly elongated and depends from said first ring member.

8. The ceiling fan blade cleaner of claim 7, wherein said first arm further comprises:

a first top surface;

a first beam downwardly projected from said first top surface, said first beam inwardly biased toward a centerline of said first top surface;

a second beam downwardly projected from said first top surface, said second beam positioned opposite to said first beam, said second beam inwardly biased toward said centerline of said first top surface; and a first channel formed from said first top surface, said first beam and said second beam, said first channel receiving and mechanically impinging a dusting cloth apparatus.

9. The ceiling fan blade cleaner of claim 8, wherein said first arm further comprises a first pivot and a second pivot, provided as means for adjusting an angle of said first arm for optimum cleaning efficiency of said ceiling fan blade cleaner.

10. The ceiling fan blade cleaner of claim 6, wherein said second arm is linearly elongated and depends from said second ring member.

11. The ceiling fan blade cleaner of claim 10, wherein said second arm further comprises:

a second top surface;

a third beam downwardly projected from said second top surface, said third beam inwardly biased toward a centerline of said second top surface;

a fourth beam downwardly projected from said second top surface, said fourth beam positioned opposite to said third beam, said fourth beam inwardly biased toward said centerline of said second top surface; and a second channel formed from said second top surface, said third beam and said fourth beam, said second channel receiving and mechanically impinging a dusting cloth apparatus.

12. The ceiling fan blade cleaner of claim 11, wherein said second arm further comprises a second pivot and a third pivot, provided as means for adjusting an angle of said second arm for optimum cleaning efficiency of said ceiling fan blade cleaner.

13. The ceiling fan blade cleaner of claim 1, wherein said pair of dusting cloth apparatuses comprise:

a first dusting cloth apparatus, said first dusting cloth apparatus downwardly projecting from said first arm; and a second dusting cloth apparatus, said second dusting cloth apparatus downwardly projecting from said second arm.

14. The ceiling fan blade cleaner of claim 13, wherein said first dusting cloth apparatus comprises:

a first top segment;

a first side segment, said first side segment depending from said first top segment, said first side segment inwardly biased toward a centerline of said first top segment;

a second side segment, said second side segment depending from said first top segment, said second side segment inwardly biased toward said centerline of said first top segment; and a first dusting cloth, said first dusting cloth mechanically impinged within said first top segment, said first side segment and said second side segment.

15. The ceiling fan blade cleaner of claim 14, wherein said first dusting cloth apparatus is a disposable component of said ceiling fan blade cleaner.

16. The ceiling fan blade cleaner of claim 14, wherein said first dusting cloth is chemically treated to enhance dust-attraction of said first dusting cloth.

17. The ceiling fan blade cleaner of claim 13, wherein said second dusting cloth apparatus comprises:

a second top segment;

a third side segment, said third side segment depending from said second top segment, said third side segment inwardly biased toward a centerline of said second top segment;

a fourth side segment, said fourth side segment depending from said second top segment, said fourth side segment inwardly biased toward said centerline of said second top segment; and a second dusting cloth, said second dusting cloth mechanically impinged within said second top segment, said third side segment and said fourth side segment.

18. The ceiling fan blade cleaner of claim 17, wherein said second dusting cloth apparatus is a disposable component of said ceiling fan blade cleaner.

19. The ceiling fan blade cleaner of claim 17, wherein said second dusting cloth is chemically treated to enhance dust-attraction of said second dusting cloth.

20. The ceiling fan blade cleaner of claim 1 further comprising an adapter collar for attachment of said ceiling fan blade cleaner to a narrow component of a ceiling fan.

* * * * *